US009719049B2

(12) United States Patent
Morigaki et al.

(10) Patent No.: US 9,719,049 B2
(45) Date of Patent: Aug. 1, 2017

(54) SURFACTANT-CONTAINING SOLUTION

(71) Applicant: Lion Corporation, Tokyo (JP)

(72) Inventors: Atsunori Morigaki, Tokyo (JP); Nobukazu Shogase, Tokyo (JP)

(73) Assignee: Lion Corporation (JP)

( * ) Notice: Subject to any disclaimer, the term of this patent is extended or adjusted under 35 U.S.C. 154(b) by 0 days.

(21) Appl. No.: 15/031,683

(22) PCT Filed: Oct. 31, 2014

(86) PCT No.: PCT/JP2014/079092
§ 371 (c)(1),
(2) Date: Apr. 22, 2016

(87) PCT Pub. No.: WO2015/064746
PCT Pub. Date: May 7, 2015

(65) Prior Publication Data

US 2016/0244697 A1 Aug. 25, 2016

(30) Foreign Application Priority Data

Oct. 31, 2013 (JP) ..... 2013-227720

(51) Int. Cl.

| | |
|---|---|
| ***C11D 1/12*** | (2006.01) |
| ***C11D 3/16*** | (2006.01) |
| ***C11D 3/30*** | (2006.01) |
| ***C11D 1/28*** | (2006.01) |
| ***C11D 3/20*** | (2006.01) |
| ***C11D 3/34*** | (2006.01) |
| ***C11D 1/22*** | (2006.01) |

(52) U.S. Cl.
CPC ..... *C11D 1/28* (2013.01); *C11D 1/12* (2013.01); *C11D 1/123* (2013.01); *C11D 1/22* (2013.01); *C11D 3/2075* (2013.01); *C11D 3/30* (2013.01); *C11D 3/3418* (2013.01)

(58) Field of Classification Search
CPC .... C11D 1/12; C11D 1/22; C11D 3/30; C11D 3/2075
USPC ..... 510/238, 426, 488, 492, 499
See application file for complete search history.

(56) References Cited

U.S. PATENT DOCUMENTS

| | | | | |
|---|---|---|---|---|
| 2003/0073599 | A1* | 4/2003 | Willman | C11D 1/65 510/357 |
| 2005/0170985 | A1* | 8/2005 | Huish | C11D 1/28 510/357 |
| 2006/0074004 | A1* | 4/2006 | Johnson | C11D 1/65 510/499 |
| 2009/0264329 | A1* | 10/2009 | Underwood | C11D 3/044 510/109 |
| 2010/0028370 | A1* | 2/2010 | Zankel | A61K 47/48246 424/181.1 |
| 2010/0093594 | A1* | 4/2010 | Huish | C11D 1/28 510/337 |
| 2010/0256035 | A1* | 10/2010 | Konishi | C11D 3/43 510/218 |
| 2010/0267605 | A1* | 10/2010 | Huish | A61K 8/466 510/357 |
| 2011/0201533 | A1* | 8/2011 | Ponder | C11D 1/667 510/221 |
| 2012/0165240 | A1* | 6/2012 | Finison | C11D 3/0057 510/365 |

FOREIGN PATENT DOCUMENTS

| | | | |
|---|---|---|---|
| JP | 0565267 | A | 3/1993 |
| JP | 2002294300 | A | 10/2002 |
| JP | 2003521563 | A | 7/2003 |
| JP | 2008094942 | A | 4/2008 |
| JP | 2013203775 | A | 10/2013 |
| WO | WO2014/054541 | * | 4/2010 |
| WO | 2011046170 | A1 | 4/2011 |
| WO | 2012144438 | A1 | 10/2012 |

OTHER PUBLICATIONS

Japanese Patent Office, "International Search Report" in connection with related International Application No. PCT/JP2014/079092, dated Feb. 10, 2015, 4 pages.

* cited by examiner

*Primary Examiner* — Gregory R Delcotto
(74) *Attorney, Agent, or Firm* — Kolisch Hartwell, P.C.

(57) ABSTRACT

A surfactant solution of the present invention includes a component (a): an α-sulfonated fatty acid ester salt; a component (b): an alkanolamine; a component (c): an aromatic sulfonic acid; and a component (d): water, wherein the content of the component (a) is within a range from 30 to 45 mass %, the molar ratio represented by (b)/(a) is within a range from 0.05 to 0.5, and the molar ratio represented by (b)/(c) is within a range from 0.5 to 2.

4 Claims, No Drawings

SURFACTANT-CONTAINING SOLUTION

TECHNICAL FIELD

The present invention relates to a surfactant solution.

Priority is claimed on Japanese Patent Application No. 2013-227720, filed Oct. 31, 2013, the content of which is incorporated herein by reference.

BACKGROUND ART

An α-sulfonated fatty acid ester salt (α-SF salt) is conventionally distributed in the form of a solid product (such as a flake or a powder), and is mainly used as a washing component of a powdery detergent. However, in the case of using an α-SF salt in a liquid detergent, it is necessary to preliminarily prepare a liquid obtained by dissolving or dispersing a flaky solid product of an α-SF salt in water, etc. before an α-SF salt is added into a main mixing chamber.

In addition to an α-SF salt, a linear alkylbenzene sulfonates (LAS) and a polyoxyethylene alkyl ether sulfate (AES), etc. are widely used as a washing component of a detergent. These LAS and AES have already distributed in the form of a high-concentration solution (a condensed solution).

The viscosity of an α-SF solution generally increases as the concentration thereof increases. When the concentration reaches about 30 wt % or more, an α-SF salt forms a hexagonal structure and becomes in a gel state which has lost fluidity. When a gelled salt is heated under normal pressure so as to evaporate the water thereof and to condense the gelled salt, the viscosity decreases under a heating condition of 50° C. to 100° C., and a gelled salt becomes in a slightly flowable state within a certain concentration range. When further continuing this condensation, the viscosity increases again, and the fluidity is lost. Under this kind of a fluidity-losing condition, the transportation by a tanker or a ship is difficult, and transportation costs, etc. are required.

In contrast, there has been proposed a method of improving the fluidity of concentrated α-SF solution.

For example, there has been disclosed the method of using both of an α-SF salt at a specific amount and an alcohol having a carbon number of 6 to 22 in which the proportion of a branched alcohol is 60 mass % or more (see Patent Literature 1). According to this method, a fluidity-improving effect is obtained at room temperature (about 25° C. to 30° C.).

CITATION LIST

Patent Literature

Patent Literature 1—Japanese Unexamined Patent Application, First Publication No. 2008-94942.

SUMMARY OF INVENTION

Technical Problem

However, when being solidified at a low temperature, a surfactant solution, which contains the α-SF salt at a high concentration and is obtained by using the method described in Patent Literature 1, is not restored to the dispersion state before solidification and keep losing fluidity even if being subsequently warmed to around room temperature. In other words, the surfactant solution does not have the restoration from solidification at low temperature.

The present invention was completed in consideration of the aforementioned circumstances, and an object of the present invention is to provide the surfactant which contains the α-SF salt at a high concentration and has the fluidity at room temperature and the restoration from the solidification at low temperature.

Solution to Problem

As the result of the intensive study, the present inventors provide the following solution to solve the aforementioned objects.

In other words, a surfactant solution of the present invention is characterized by including a component (a): an α-sulfonated fatty acid ester salt; a component (b): an alkanolamine; a component (c): an aromatic sulfonic acid; and a component (d): water, wherein the content of the component (a) is within a range from 30 to 45 mass %, the molar ratio represented by (b)/(a) is within a range from 0.05 to 0.5, and the molar ratio represented by (b)/(c) is within a range from 0.5 to 2.

In the surfactant solution of the present invention, it is preferable that the total content of the component (a), the component (b), the component (c) and the component (d) be 90 mass % or more.

Also, in the surfactant solution of the present invention, it is preferable that the component (c) be at least one selected from the group consisting of xylene sulfonic acid, ethylbenzene sulfonic acid and toluene sulfonic acid, and the total content of the component (a), the component (b), the component (c) and the component (d) be 99 mass % or more.

Also, it is preferable that the surfactant solution of the present invention further include ethanol at 5 to 15 mass %, the component (c) be at least one selected from the group consisting of alkylbenzene sulfonic acid and cumene sulfonic acid, and the total content of the component (a), the component (b), the component (c), the component (d) and ethanol be 99 mass % or more.

Advantageous Effects of Invention

The surfactant solution of the present invention contains the α-SF salt at a high concentration and has the fluidity at room temperature and the restoration from solidification at low temperature.

DESCRIPTION OF EMBODIMENTS

Surfactant Solution

The surfactant solution of the present invention includes the component (a): an α-sulfonated fatty acid ester salt; the component (b): an alkanolamine; the component (c): an aromatic sulfonic acid; and the component (d): water.

Component (a): α-Sulfonated Fatty Acid Ester Salt

It is possible to use a compound obtained by a known production method as an α-sulfonated fatty acid ester salt (an α-SF salt: the component (a)). For example, it is possible to use a compound obtained by the method in which, by using a chamber-type reactor equipped with a stirring machine according to a conventional method, a fatty acid ester, which is a starting material, is sulfonated through the contact with an anhydrous sulfuric acid, etc. to prepare α-sulfonated fatty acid ester (α-SF acid), and subsequently, the prepared α-SF acid is neutralized with sodium hydroxide, etc. Herein, bleaching can be carried out using hydrogen peroxide before and after the neutralization.

Preferable examples of the component (a) include a compound represented by the following general formula (a1).

[Chemistry 1]

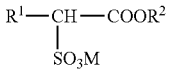

(a1)

[In the formula, $R^1$ represents a hydrocarbon group having 8 to 18 carbon atoms, $R^2$ represents a hydrocarbon group having 1 to 6 carbon atoms, and M represents a counter ion.]

In the formula (a1), the hydrocarbon group represented by $R^1$ can be liner or branched, or can have a cyclic structure. Of these, the hydrocarbon groups represented by $R^1$ is preferably an aliphatic hydrocarbon group, more preferably a liner or branched alkyl group or a liner or branched alkenyl group, much more preferably a liner alkyl group or a liner alkenyl group. The number of carbon atoms of $R^1$ is 8 to 18, preferably 10 to 18, more preferably 10 to 16, and much more preferably 14 to 16. When the number of carbon atoms of $R^1$ is 8 or more, surface activity becomes strong, and detergency is improved as a washing component. Meanwhile, when the number of carbon atoms of $R^1$ is 18 or less, the appearance stability of a surfactant solution is improved, and particularly, it is possible to suppress gelation, or precipitation or cloudiness during storage.

In the formula (a1), the hydrocarbon group represented by $R^2$ can be liner or branched, or can have a cyclic structure. Of these, the hydrocarbon groups represented by $R^2$ is preferably an aliphatic hydrocarbon group, more preferably a liner or branched alkyl group or a liner or branched alkenyl group, much more preferably a liner alkyl group or a branched alkyl group. The number of carbon atoms of $R^2$ is 1 to 6, preferably 1 to 3. Examples of the hydrocarbon group represented by $R^2$ include a methyl group, an ethyl group, n-propyl group, and isopropyl group. Because detergency is well improved as a washing component, a methyl group, an ethyl group, and an n-propyl group are preferable, and a methyl group is particularly preferable.

In the formula (a1), M represents a counter ion which can form a water-soluble salt together with $R^1CH(COOR^2)SO_3^-$. Examples of this counter ion include an alkali metal ion, a protonated amine, and an ammonium ion. Examples of an alkali metal which can be the counter ion include sodium and potassium. An amine which can be the counter ion can be any one of a primary amine to a tertiary amine, and the total carbon number thereof is preferable 1 to 6. This amine can have a hydroxy group. Because it is possible to improve solubility in water of a surfactant solution under the condition of a low temperature, the amine preferably has a hydroxy group. Examples of this type of the nine include an alkanolamine, and the number of carbon atoms of an alkanol group is preferably 1 to 3. Examples of an alkanolamine include a monoethanolamine, a diethanolamine, and a triethanolamine. As the alkanolamines, monoethanolamine is preferable.

M preferably represents an alkali metal ion, more preferably a sodium ion and a potassium ion, and particularly preferably sodium ion because these alkali metal ions are easily available and the fluidity-improving effect of a surfactant solution is well exerted.

One of the particularly preferable examples of the component (a) is the compound represented by the general formula (a1), in which $R^1$ represents a linear or branched alkyl group having 12 to 18 carbon atoms or a linear or branched alkenyl group having 12 to 18 carbon atoms, and $R^2$ represents a methyl group.

The component (a) can be used singularly or in combination of two or more thereof.

As the component (a), the mixture obtained by mixing the compounds having the fatty acid residue (which refers to an acyl group moiety) having different carbon atoms is preferably used because detergency is improved as a washing component and the solubility in water is improved. Specifically, it is preferable to use the mixture of the α-SF salt (C16) represented by the formula (a1), in which $R^1$ represents a hydrocarbon group having 14 carbon atoms, and the α-SF salt (C18) represented by the formula (a1) in which $R^1$ represents a hydrocarbon group having 16 carbon atoms. The mixing ratio (mass ratio) between C16 and C18 is preferably C16:C18=45:55 to 95:5, more preferably C16:C18=60:40 to 90:10, and much more preferably C16:C18=80:20 to 85:15. When the mass ratio is within the preferable range, the detergency, the solubility in water and the appearance stability become very good.

Also, when the mixture of the α-SF salt (C16) represented by the formula (a1), in which $R^1$ represents a liner alkyl group, and the α-SF salt (C18) represented by the formula (a1), in which $R^1$ represents a liner alkyl group, is used as the component (a), the total content of C16 and C18 is preferably 95 mass % or more relative to the total mass of the mixture, and more preferably 98 mass % or more.

Also, preferable examples of the component (a) include a compound having a naturally occurring fatty acid residue such as a compound derived from palm oil, palm kernel oil or coconut oil. Specifically, a fatty acid methyl ester derived from these naturally occurring oil components is modified by a method such as distillation such that a fatty acid having 16 carbon atoms and fatty acid having 18 carbon atoms become main components in the composition of a fatty acid according to need, and a saturated fatty acid methyl ester mixture, which is obtained by hydrogenating a fatty acid component having an unsaturated bond, is sulfonated to thereby produce the preferable example of the component (a).

In the surfactant solution of the present invention, the content of the component (a) is 30 to 45 mass % based on the total mass of the surfactant solution, preferably 30 to 40 mass %, and more preferably 35 to 40 mass %.

When the content of the component (a) is the lower limit or more, the effect of the present invention is remarkably exerted. Meanwhile, when the content of the component (a) is the upper limit or less, the fluidity of the surfactant solution is well enhanced.

Component (b): Alkanolamine

Examples of the component (b) include monoethanolamine, diethanolamine, triethanolamine, 4-amino-1-butanol, 6-amino-1-hexanol, 2-amino-1,3-propanediol, 3-amino-1,2-propanediol, 1-amino-2-propanol, and 2-amino-1-propanol. Of these, at least one selected from the group consisting of monoethanolamine, diethanolamine and triethanolamine is preferable, and monoethanolamine amine is particularly preferable because the fluidity at room temperature, the restoration from solidification at low temperature, and the appearance stability become very good.

The component (b) can be used singularly or in combination of two or more thereof.

In the surfactant solution of the present invention, the content of the component (b) is 0.3-4 mass % based on the total mass of the surfactant solution, preferably 0.5 to 3.5 mass %, and more preferably 1 to 3 mass %.

When the content of the component (b) is the lower limit or more, the fluidity at room temperature, the restoration from solidification at low temperature and the appearance stability are well improved. Meanwhile, when the content of the component (b) is the upper limit or less, the appearance stability are well improved.

Regarding the mixing ratio of the component (a) and the component (b) in the surfactant solution of the present invention, the molar ratio represented by (b)/(a) is 0.05 to 0.5, preferably 0.1 to 0.5, and more preferably 0.15 to 0.5.

When the molar ratio represented by (b)/(a) is the preferable lower limit or more, the fluidity at room temperature and the restoration from solidification at low temperature are well improved. Meanwhile, when the molar ratio is the preferable upper limit or less, the appearance stability is well improved.

In the present invention, the "molar ratio represented by (b)/(a)" means the ratio of the molar number of the component (b) to the molar number of the component (a) contained in the surfactant solution.

Component (c): Aromatic Sulfonic Acid

Examples of the component (c) include xylene sulfonic acid, an ethylbenzene sulfonic acid, a toluenesulfonic acid, an alkylbenzene sulfonic acid, a cumene sulfonic acid, a substituted naphthalene sulfonic acid and a non-substituted naphthalene sulfonic acid. Of these, a xylene sulfonic acid, an ethylbenzene sulfonic acid, a toluene sulfonic acid, an alkylbenzene sulfonic acid and a cumene sulfonic add are preferable because the fluidity at room temperature, the restoration from solidification at low temperature, and the appearance stability become very good.

In an alkylbenzene sulfonic acid, a hydrocarbon group bonded to a benzene ring can be liner or branched, or can have a cyclic structure. Of these, a hydrocarbon group bonded to a benzene ring is preferably an aliphatic hydrocarbon group, more preferably a liner or branched alkyl group or a liner or branched alkenyl group, much more preferably a liner alkyl group or a liner alkenyl group. The number of carbon atoms of a hydrocarbon group bonded to a benzene ring is preferably 8 to 18, more preferably 10 to 18, and much more preferably 12 to 16. When the number of carbon atoms of hydrocarbon group bonded to a benzene ring is 8 or more, surface activity becomes strong, detergency is improved as a washing component. Meanwhile, when the number of carbon atoms of hydrocarbon group bonded to a benzene ring is 18 or less, the appearance stability of a surfactant solution is easily ensured.

Of these, at least one selected from the group consisting of a xylene sulfonic acid, an ethylbenzene sulfonic acid and a toluene sulfonic acid are preferable, and at least one selected from the group consisting of meta-xylene sulfonic acid, an ethylbenzene sulfonic acid and a para-toluene sulfonic acid are more preferable, and a meta-xylene sulfonic acid is particularly preferable because the appearance stability becomes very good.

Because the component (c) is generally blended into a detergent, at least one selected from the group consisting of an alkylbenzene sulfonic acid and a cumene sulfonic acid are preferable in terms of no limitation the freedom degree of a detergent composition. Because the component (c) acts as a surfactant when being blended into a liquid detergent, an alkylbenzene sulfonic acid is particularly preferable.

The component (c) can be used singularly or in combination of two or more thereof.

In the surfactant solution of the present invention, the content of the component (c) is 0.9 to 12 mass % based on the total mass of the surfactant solution, preferably 1.5 to 10.5 mass %, and more preferably 3-9 mass %.

When the content of the component (c) is the lower limit or more, the fluidity at room temperature, the restoration from solidification at low temperature and the appearance stability are well improved. Meanwhile, when the content of the component (b) is the upper limit or less, the appearance stability are well improved.

Regarding the mixing ratio of the component (b) and the component (c) in the surfactant solution of the present invention, the molar ratio represented by (b)/(c) is 0.5 to 2 and preferably 0.5 to 1.5.

When the molar ratio represented by (b)/(c) is the preferable lower limit or more, the fluidity at room temperature, the restoration from solidification at low temperature and the appearance stability are well improved. Meanwhile, when the molar ratio is the preferable upper limit or less, the restoration from solidification at low temperature is improved.

In the present invention, the "molar ratio represented by (b)/(c)" means the ratio of the molar number of the component (b) to the molar number of the component (c) contained in the surfactant solution.

Component (d): Water

The surfactant solution of the present invention includes water in terms of preparation easiness and the solubility in water when being used.

In the surfactant solution, the content of water is less than 70 mass % based on the total mass of the surfactant solution, and preferably 60 mass % or less. Meanwhile, the lower limit thereof is preferably 40 mass % and more preferably 50 mass %.

When the surfactant solution of the present invention is used to produce the liquid detergent containing an α-SF salt as a washing component, it is preferable to reduce the contamination by any components other than the component (a) to (d) from the surfactant solution, By reducing the contamination by any other components, the freedom degree of a liquid detergent composition is hardly limited when the surfactant solution is blended into a liquid detergent.

From this viewpoint, the surfactant solution of the present invention, the total amount of the components (a) to (d) is preferably 90 mass % or more based on the total mass of the surfactant solution, more preferably 95 mass % or more, and much more preferably 99 mass % or more, and can be 100 mass % the surfactant solution made of only the components (a) to (d)).

Particularly when at least one selected from the group consisting of a xylene sulfonic acid, an ethylbenzene sulfonic acid and a toluene sulfonic acid are used as the component (c), the total amount of the components (a) to (d) is preferably 99 mass % or more and more preferably 100 mass %.

Optional Components

If necessary, the surfactant solution of the present invention can be blended with any components other than the components (a) to (d) described above to such an extent that the effects of the present invention are not lost.

Examples of these other components include an alcohol having 1 to 3 carbon atoms, a pH buffer, preservatives and a chelating agent.

In the surfactant solution of the present invention, the fluidity of the surfactant solution is further improved by containing an alcohol having 1 to 3 carbon atoms. Examples of the alcohol having 1 to 3 carbon atoms include monohydric alcohols such as methanol, ethanol, n-propanol and isopropanol; and polyhydric alcohols such as ethylene glycol and propylene glycol. Of these, a monohydric alcohol is preferable, and ethanol is more preferable.

Particularly when at least one selected from the group consisting of alkylbenzene sulfonic acid and cumene sulfonic acid are used as the component (c), it is preferable that the surfactant solution of the present invention further contain ethanol. By simultaneously using such a specific component (c) and ethanol, the fluidity of the surfactant solution is further improved. In addition, the restoration from solidification at low temperature becomes very good. In this case, in the surfactant solution of the present invention, the content of ethanol is preferably 5 to 15 mass % based on the total mass of the surfactant solution. Also, the total amount of the components (a) to (d) and ethanol is preferably 99 mass % and more preferably 100 mass %. This kind of the surfactant solution has less contamination by any components other than the components (a) to (d) and ethanol, and therefore, when the liquid detergent containing an α-SF salt is produced as a washing component, it is possible to reduce the effect of the blending of the surfactant solution to the temporal stability or performance of the liquid detergent.

In the surfactant solution of the present invention, pH at 30° C. is preferably 5 to 9 and more preferably 6 to 8.

As long as the pH of the surfactant solution is within the aforementioned preferable range, it is possible to suppress the hydrolysis of the component (a) in the surfactant solution and to more stabilize the liquid.

In the present invention, the pH of the surfactant solution can be measured by a pH meter, etc. The temperature of a sample is adjusted to 30° C. during a measurement.

In the surfactant solution of the present invention, viscosity at 30° C. is preferably 10 Pa·s and less, more preferably less 5 Pas and less, and much more preferably 1 Pa·s and less.

As long as the viscosity at 30° C. is not more than the aforementioned preferable upper limit, the surfactant solution which shows fluidity is easily obtained when tilting a container containing the surfactant solution for example.

In the present invention, the viscosity of the surfactant solution can be measured by a B-type viscometer, etc. The temperature of a sample is adjusted to 30° C. during a measurement.

The surfactant solution of the present invention can be produced by mixing the aforementioned components (a), (b), (c) and (d). For example, the surfactant solution of the present invention can be produced by dissolving the components (a), (b) and (c) and optional components in the component (d), which is a solvent, while adjusting pH to a predetermined number. As the component (a), it is possible to use any of a pasty product and a solid product after neutralization or bleaching.

Of these, the particularly preferable production method is the method including obtaining the mixed solution of the components (b), (c) and (d) and mixing the mixed solution with the component (a). According to this production method, the component (a) can be well dispersed, and the fluidity and the restoration from solidification at low temperature become very good.

In the aforementioned surfactant solution of the present invention, the component (d) is used as a solvent, and the component (a): an α-sulfonated fatty acid ester salt, the component (b): an alkanolamine, and the component (c): an aromatic sulfonic acid are used in combination in a specific mixing ratio, and therefore, even if an α-SF salt is contained as a surfactant a high concentration of 30 mass % or more, the fluidity at room temperature (approximately 25° C. to 30° C.) and the restoration from solidification at low temperature are good.

Also, according to the surfactant solution of the present invention, a transparent appearance is maintained over time, and the appearance stability is excellent.

When a high-concentration solution (a condensed solution) is prepared using the α-SF salt, the transportation by a tanker or a ship becomes easy, and a transportation cost can be reduced. In addition, when producing a liquid detergent, it is not necessary to preliminarily dissolve or disperse the condensed solution, and it is easy to blend this condensed solution into a liquid detergent.

EXAMPLES

Hereinafter, the present invention will be more specifically described with reference to Examples and Comparative Examples, but the present invention is not limited to the following specific examples. It should be noted that "%" indicates "mass %" in the examples unless otherwise specified.

(1) Used Starting Materials

The starting materials shown in Table 1 are used.

Herein, the flaky solid product of the α-sulfonated fatty acid methyl ester sodium salt (hereinafter, referred to as the "α-SF salt solid product") was used for the blending of the α-sulfonated fatty acid methyl ester sodium salt (α-SF-Na) which is the component (a). The α-SF salt solid product was prepared by producing the condensed product of the pasty α-SF salt as follows, and then cooling and pulverizing this condensed product.

Production of Pasty α-SF-1

Methyl palmitate (trade name: Pastel M-16 manufactured by Lion Corporation) and methyl stearate (trade name: Pastel M-180 manufactured by Lion Corporation) were mixed in the mass ratio of 85:15, to thereby obtain the fatty acid methyl ester mixture. This fatty acid methyl ester mixture 330 kg was added into the reactor which was equipped with a stirring machine and had the volume of 1 kL. Then, the bubbling was carried out by using 115.6 kg (1.2 times by mole relative to the fatty acid methyl ester mixture) of the $SO_3$ gas (a sulfonating gas) which was diluted with a nitrogen gas to 4 vol % while stirring the fatty acid methyl ester mixture. The reaction temperature was 80° C. The sulfonating gas was blown into the fatty acid methyl ester mixture at a constant rate over 3 hours. Then, 1.5 parts by mass of the anhydrous sodium sulfate was added to 100 parts by mass of the fatty acid methyl ester mixture, and the aging was carried out for 30 minutes while maintaining 80° C.

Then, methanol 13.5 kg was supplied as a lower alcohol, and the esterification was carried out at the temperature condition of 80° C. for the aging time of 30 minutes.

Subsequently, the esterified product withdrawn from the reactor was continuously neutralized by adding the equivalent amount of aqueous sodium hydroxide thereto using a line mixer.

Subsequently, this neutralized product was injected into the bleaching agent-mixing line, and mixed with the supplied 35 vol % aqueous hydrogen peroxide. Then, the bleaching was carried out while maintaining 80° C., to thereby obtain the pasty α-SF-1.

Herein, the supply amount of the 35 vol % aqueous hydrogen peroxide was 1 mass % of the concentration of the anionic surfactant (the total concentration of the α-sulfonated fatty acid methyl ester sodium salt (α-SF-Na) and the α-sulfonated fatty acid disodium salt (di-Na salt)) in terms of pure content. Also, the molecular weight of α-SF-Na contained in the obtained α-SF-1 was calculated from the carbon chain length ratio (mass ratio) of the used starting materials, and the molecular weight of 377 was obtained.

Production of Pasty α-SF-2

Methyl palmitate (trade name: Pastel M-16 manufactured by Lion Corporation) and methyl stearate (trade name: Pastel M-180 manufactured by Lion Corporation) were mixed in the mass ratio of 6:4, to thereby obtain the fatty acid methyl ester mixture. This fatty acid methyl ester mixture 330 kg was added into the reactor which was equipped with a stirring machine and had the volume of 1 kL. Then, 5 parts by mass of anhydrous sodium sulfate was added to 100 parts by mass of the fatty acid methyl ester mixture as a coloring inhibitor while stirring the fatty acid methyl ester mixture. Then, the bubbling was carried out by using 112.8 kg (1.2 times by mole relative to the fatty acid methyl ester mixture) of the $SO_3$ gas (a sulfonating gas) which was diluted with a nitrogen gas to 4 vol % while continuing the stirring. The reaction temperature was 80° C. The sulfonating gas was blown into the fatty acid methyl ester mixture at a constant rate over 3 hours. Then, the aging was carried out for 30 minutes while continuously maintaining 80° C.

Then, α-SF-2 was obtained in the same manner as the production of the pasty α-SF-1 described above.

Herein, the molecular weight of α-SF-Na contained in the obtained α-SF-2 was calculated from the carbon chain length ratio (mass ratio) of the used starting materials, and the molecular weight of 384 was obtained.

Condensation of Pasty α-SF Salt

Each of the obtained pasty α-SF salts (α-SF-1, α-SF-2) was introduced at 35 kg/hour into the vacuum thin-film evaporator which rotated at the rotation speed of 1060 rpm and the tip speed of the impeller blade of about 11 m/s, and the condensation was carried out under the conditions of the inner wall-heating temperature (the temperature of the heat transfer surface) of 135° C. and the vacuum degree (the pressure in the treatment section) of 0.007 to 0.014 MPa. The temperature of the obtained condensed product was 115° C., and the water content was 2.5 mass %. Herein, the used vacuum thin-film evaporator was manufactured by Kobelco Eco-Solutions Co. Ltd. (trade name: "EXEVA" (registered trademark), the heat transfer surface: 0.5 $m^2$, the inner diameter of cylindrical treatment section: 205 mm, the clearance between the heat transfer surface and the tip of the impeller blade which was a scraping means: 3 mm).

Production of α-SF Salt Solid Product:

Each of the obtained respective condensed products was continuously supplied at 222 kg/h to the double-belt type belt cooler (NR3-Lo. Cooler) manufactured by Nippon Belting Co., Ltd. in which the clearance between the input pulleys was adjusted to 2 mm, and was cooled. At that time, the belt moving speed was set to 6 m/s, the flow rate of cooling water on the upper belt side was set to 1500 L/h (the cooling was carried out by making cooling water flow down the back of the belt in counter-current system), the flow rate of cooling water on the lower belt side was set to 1800 L/h (the cooling was carried out by spraying cooling water on the back of the belt), and the temperature of the supplied cooling water was adjusted to 20° C. Subsequently, the α-SF salt-containing product sheet discharged from the cooling belt was pulverized at the rotation speed of 200 rpm by the attached pulverizer equipped in the vicinity of the discharge pulley, to thereby obtain each of the flaky α-SF salt solid products (α-SF-1, α-SF-2) at 25° C.

The concentration of the anionic surfactant (the total concentration of the α-sulfonated fatty acid methyl ester sodium salt (α-SF-Na) and the α-sulfonated fatty acid disodium salt (di-Na salt)) in the α-SF salt solid product was measured as follows.

About 0.3 g of the sample was accurately weighed and added into the volumetric flask having the capacity of 200 mL, ion-exchanged water (distilled water) was added to the volumetric flack up to the mark, and the sample was dissolved in ion-exchanged water by using ultrasonic wave. After the dissolving, the solution was cooled to about 25° C., and 5 mL was taken from this sample aqueous solution by a pipette to the titration bottle. In this titration bottle, 25 mL of the methylene blue indicator and 15 mL of chloroform were added, and moreover, the 0.004 mol/L benzethonium chloride solution 5 mL was added. Then, the titration was carried out by using the 0.002 mol/L sodium alkylbenzene sulfonate solution. In the titration, the titration bottle was sealed and vigorously shaken each time, and allowed to stand. Then, the point, in which the separated two layers became the same color tone when a white plate was used as a background, was determined as the end point.

In the same manner, the blank test (the same test as described above except for not using the sample) was carried out, and the difference in the titer of the sodium alkylbenzene sulfonate solution and the following formula were used to calculate the anionic surfactant concentration in the α-SF salt solid product. Herein, the anionic surfactant concentration refers to the concentration of the sum of the α-SF salt, which is a washing active component, and α-sulfonated fatty acid di-alkali salt (di-salt) which is one of the byproducts.

Anionic Surfactant Concentration (mass %)=(Titer in Blank Test (mL)−Titer (mL))×0.002 (mol/L)× Molecular Weight of α-Sulfonated Fatty Acid Methyl Ester Sodium Salt/(Sample Collection Amount (g)×5 (mL)/200 (mL))/10

The results of the measurements described above revealed that the concentration of the anionic surfactant in the α-SF salt solid product (α-SF-1) was 89.2 mass %, and the concentration of the anionic surfactant in the α-SF salt solid product (α-SF-2) was 88.2 mass %.

The concentration of the α-sulfonated fatty acid disodium salt (di-Na salt)) in the α-SF salt solid product was measured as follows.

The respective weights 0.02 g, 0.05 g and 0.1 g of the standard product of the di-Na salt were accurately weighed and added into the volumetric flasks having the capacity of 200 mL, and about 50 mL of water and about 50 mL of ethanol were added thereto, to thereby dissolve the respective di-Na salts. After the dissolving, the solution was cooled to about 25° C., and methanol was accurately added up to the mark, to thereby prepare the standard solutions. About 2 mL of the standard solutions were filtered using the chromatodisk of 0.45 Then the standard solutions were subjected to the analysis using the high performance liquid chromatography and the following measuring conditions, and the calibration curve was prepared from the peak areas.

Measurement Conditions for HPLC Analysis

- Device: LC-6A (manufactured by Shimadzu Corporation)
- Column: Nucleosil 5SB (GL Sciences Inc.)
- Column temperature: 40° C.
- Detector: differential refractive index detector RID-6A (manufactured by Shimadzu Corporation)
- Mobile phase: 0.7% sodium perchlorate solution having $H_2O/CH_3OH$=¼ (volume ratio)
- Flow rate: 1.0 mL/min.
- Addition amount: 100 μL Next, 1.5 g of α-SF salt solid product was accurately weighed and added into the volumetric flasks having the capacity of 200 mL, and about 50 mL of water and about 50 mL of ethanol were added thereto, to thereby dissolve the α-SF salt solid product. After the dissolving, the solution was cooled to about 25° C., and methanol was accurately added up to the mark, to thereby prepare the sample solution. About 2 mL of the sample solution was filtered using the chromato-disk of 0.45 μm. Then, the sample solution was subjected to the analysis using the high performance liquid chromatography and the same measuring conditions as described above, and the concentration of the di-Na salt in the sample solution was obtained by using the calibration curve described above.

The results of the measurements described above revealed that the concentration of the di-Na salt in the α-SF salt solid product (α-SF-1) was 3.8 mass %, and the concentration of the di-Na salt in the α-SF salt solid product (α-SF-2) was 2.6 mass %.

Consequently, the concentration of the α-sulfonated fatty acid methyl ester sodium salt (α-SF-Na) in the α-SF salt solid product (α-SF-1) was calculated, and 85.4 mass % was obtained. Also, the concentration of the α-sulfonated fatty acid methyl ester sodium salt (α-SF-Na) in the α-SF salt solid product (α-SF-2) was calculated, and 85.6 mass % was obtained. In the present examples, these values were used for the content of the component (a).

In the Tables, "Balance" showing the content of water means the remainder to be added such that the total content (mass %) of all the components contained in the surfactant solution becomes 100 mass %.

In the Tables, "(b)/(a) (molar ratio)" has the same meaning of the molar ratio represented by (b)/(a), and has the same meaning the ratio of the mole number of the component (b) to the mole number of the component (a) contained in the surfactant solution. Also, "(b)/(c) (molar ratio)" has the same meaning of the molar ratio represented by (b)/(c), and has the same meaning the ratio of the mole number of the component (b) to the mole number of the component (c) contained in the surfactant solution.

First, 75 mass % monoethanolamine aqueous solution was diluted with 80% of the amount of water to be used as a balance, and then neutralized with an aromatic sulfonic acid to thereby adjust the pH thereof to 9 or less. Subsequently, the α-SF salt solid product (α-SF-1, α-SF-2) was blended thereinto, and was stirred at about 50° C. to thereby obtain a uniform liquid. Then, 75 wt % monoethanolamine aqueous solution or the aromatic sulfonic acid was added thereto so as to adjust the pH to 7.0. Finally, water was added so as to adjust the total content of all the components to 100 mass %, and the surfactant solutions of the respective examples were prepared.

TABLE 1

| | Signs | Name of Starting Materials and Molecular Weights | Suppliers, etc. |
|---|---|---|---|
| Component (a): α-Sulfonated Fatty Acid Ester Salt | α-SF-Na in α-SF-1 | α-Sulfonated Fatty Acid Methyl Ester Sodium Salt (chain length mixing mass ratio: C16/C18 = 85/15), Molecular Weight: 377 | α-SF Salt Solid Product: Synthetic Compound (flaky) Concentration of α-SF-Na: 85.4 mass % |
| | α-SF-Na in α-SF-2 | α-Sulfonated Fatty Acid Methyl Ester Sodium Salt (chain length mixing mass ratio: C16/C18 = 6/4), Molecular Weight: 384 | α-SF Salt Solid Product: Synthetic Compound (flaky) Concentration of α-SF-Na: 85.6 mass % |
| Component (b): Alkanolamine | MEA | Monoethanolamine, Molecular Weight: 61.1 | Monoethanolamine Diluted with Water (75 mass % aqueous solution), Manufactured by Nippon Shokubai Co. Ltd. |
| | TEA | Triethanolamine, Molecular Weight: 149.2 | Manufactured by Nippon Shokubai Co. Ltd. |
| Component (c): Aromatic Sulfonic Acid | m-Xylene Sulfonic Acid | Taycatox 110, Molecular Weight: 186.23 | Manufactured by Tayca Corporation |
| | Ethylbenzene Sulfonic Acid | Ethylbenzene Sulfonic acid Molecular Weight: 186.23 | Manufactured by Sigma-Aldrich Co. LLC. |
| | PTS-H | Taycatox 300 (p-toluene sulfonic acid), Molecular Weight: 322 | Manufactured by Tayca Corporation |
| | LAS-H | Liner Alkylbenzene Sulfonic Acid, Molecular weight: 322 | Trade Name: LIPON KH-200, Manufactured by Lion Corporation |
| Aliphatic Sulfonic Acid | Methane Sulfonic Acid | Methane Sulfonic Acid, Molecular Weight: 96.11 | Manufactured by Wako Pure Chemical Industries, Ltd |
| Optional Component | Ethanol | Ethanol: 99.5% (general grade in Wako Pure Chemical Industries, etc.) | Manufactured by Wako Pure Chemical Industries, Ltd |

C16: α-SF salt represented by the general formula (a1) in which $R^1$ represents an alkyl group having 14 carbon atoms
C18: α-SF salt represented by the general formula (a1) in which $R^1$ represents an alkyl group having 16 carbon atoms (2) Production Method of Surfactant Solution The surfactant solutions were prepared in accordance with the respective compositions shown Tables 2-5 as follows.

In the Tables, the blank column of the blended component shows that the blended component was not blended. In the Tables, the content of the blended component shows wt % of pure content.

In Example 6 and Example 16, 100 wt % Triethanolamine solution was used instead of 75 wt % monoethanolamine aqueous solution.

In Comparative Examples 6 and 15, the aliphatic sulfonic acid was used instead of the aromatic sulfonic acid.

In Examples 10 and 20 and Comparative Examples 8 and 17, ethanol was added with 80% of the amount of water to be used as a balance.

During the preparation of the surfactant solution, the pH measurement was carried out using the pH meter (trade name: HM-30G, manufactured by DKK-TOA Corporation). The temperature of the sample was adjusted to 30° C.

(3) Evaluation for Surfactant Solution

The surfactant solutions of respective examples were subjected to the evaluations of the appearance stability, the fluidity and the restoration from solidification at low temperature using the evaluation method shown below. The results of these evaluations were shown in Tables 2-5.

Evaluation of Appearance Stability of Surfactant Solution

The surfactant solutions 50 mL of the respective examples were taken into the sample bottles, and heated at 50° C. for 24 hours. Then, the sample bottles were put in the thermostat chambers of 50° C. and the thermostat chambers of 30° C., and allowed to stand for one month. After the elapse of one month, the respective sample bottles stored in the thermostat chambers were visually observed to evaluate the appearance thereof in accordance with the following evaluation criteria.

A: The appearance was transparent.

B: Precipitation or cloudiness occurred at a portion of the sample bottle, but it was practically acceptable level.

C: Precipitation occurred.

Evaluation of Fluidity of Surfactant Solution

Following the aforementioned evaluation of the appearance stability, the respective sample bottles were tilted at 90 degrees, and the behaviors of surfactant solutions were observed to evaluate the fluidity in accordance with the following evaluation criteria.

A: There was clear fluidity (the viscosity was less than 5 Pa·s).

B: There was slight fluidity (the viscosity was no less than 5 Pa·s and no more than 10 Pa·s).

C: There was no fluidity.

Evaluation of Restoration from Solidification at Low Temperature for Surfactant Solution The surfactant solutions 50 mL of the respective examples were taken into the sample bottles, and cooled to −20° C. for 24 hours. Then, the sample bottles were put in the thermostat chambers of 30° C., and allowed to stand for 3 hours. After the standing, the respective sample bottles were tilted at 90 degrees, and the behaviors of surfactant solutions were observed to evaluate the restoration from solidification at low temperature in accordance with the following evaluation criteria.

A: There was clear fluidity (the viscosity was less than 5 Pa·s).

B: There was slight fluidity (the viscosity was no less than 5 Pa·s and no more than 10 Pa·s).

C: There was no fluidity.

Viscosity Measurement of Surfactant Solution

Following the aforementioned evaluations of the fluidity and the restoration from solidification at low temperature, the viscosities of the surfactant solutions in the respective sample bottles were measured. The measurement results were shown in Tables 2-5 together with the results of the evaluations of the fluidity and the restoration from solidification at low temperature.

The viscosities of the surfactant solutions were measured by the B-type viscometer (manufactured by TOKIMEC, Inc.). The temperature of the sample was adjusted to 30° C. The measurement conditions were described below.

The rotation speed was 30 rpm, and the viscosity was measured after the elapse of 30 seconds.

The rotor No. 3 was used when the viscosity was within a range of 0.1 to 5 Pa·s.

The rotor No. 1 or No. 2 was used when the viscosity was 0.1 Pa·s or less.

The rotor No. 4 was used when the viscosity was 5 Pa·s or more.

In the surfactant solution having the clear fluidity, the viscosity was 5 Pa·s or less. Also, in the surfactant solution having the slight fluidity, the viscosity was 5 Pa·s or more and 10 Pa·s or less. Herein, the viscosity was not measured for the samples having no fluidity (×) (In the Tables, "-" indicates that the viscosity was not measured.).

TABLE 2

| | | | Examples | | | | |
|---|---|---|---|---|---|---|---|
| | | | 1 | 2 | 3 | 4 | 5 |
| Components (mass %) | Component (a) | α-SF-Na in α-SF-1 | 38 | 38 | 38 | 38 | 38 |
| | | α-SF-Na in α-SF-2 | | | | | |
| | Component (b) | MEA | 0.5 | 1 | 1 | 1 | 3 |
| | | TEA | | | | | |
| | Component (c): Aromatic Sulfonic Acid | m-Xylene Sulfonic Acid | 1.5 | 1.8 | 3 | 5 | 9 |
| | | Ethylbenzene Sulfonic Acid | | | | | |
| | | PTS-H | | | | | |
| | | LAS-H | | | | | |
| | Aliphatic Sulfonic Acid | Methane sulfonic Acid | | | | | |
| | Component (d) Optional Component | Water | Balance | Balance | Balance | Balance | Balance |
| | | Ethanol | | | | | |
| | (b)/(a) (molar ratio) | | 0.081 | 0.16 | 0.16 | 0.16 | 0.49 |
| | (b)/(c) (molar ratio) | | 1.0 | 1.7 | 1.0 | 0.61 | 1.0 |
| Evaluation of Appearance Stability | | 50° C. | A | A | A | A | A |
| | | 30° C. | B | B | A | A | A |

TABLE 2-continued

| | | | | | | |
|---|---|---|---|---|---|---|
| Evaluation of Fluidity (Viscosity/Pa · s) | 50° C. | B | A | A | A | A |
| | | 5.2 | 3.6 | 0.80 | 0.75 | 0.15 |
| | 30° C. | B | B | A | A | A |
| | | 9.8 | 5.0 | 2.1 | 2.0 | 0.17 |
| Evaluation of Restoration from Solidification at Low Temperature (Viscosity/Pa · s) | | B | B | A | A | A |
| | | 9.9 | 5.1 | 4.0 | 4.9 | 0.90 |

| | | | Examples | | | | |
|---|---|---|---|---|---|---|---|
| | | | 6 | 7 | 8 | 9 | 10 |
| Components (mass %) | Component (a) | α-SF-Na in α-SF-1 | 38 | 38 | 38 | 44 | 33 |
| | | α-SF-Na in α-SF-2 | | | | | |
| | Component (b) | MEA | | 1 | 1 | 1 | 0.8 |
| | | TEA | 1 | | | | |
| | Component (c): Aromatic Sulfonic Acid | m-Xylene Sulfonic Acid | 1 | | | 3 | |
| | | Ethylbenzene Sulfonic Acid | | 3 | | | |
| | | PTS-H | | | 3 | | |
| | | LAS-H | | | | | 4.2 |
| | Aliphatic Sulfonic Acid | Methanesulfonic Acid | | | | | |
| | Component (d) | Water | Balance | Balance | Balance | Balance | Balance |
| | Optional Component | Ethanol | | | | | 10 |
| (b)/(a) (molar ratio) | | | 0.066 | 0.16 | 0.16 | 0.14 | 0.15 |
| (b)/(c) (molar ratio) | | | 1.2 | 1.0 | 0.94 | 1.0 | 1.0 |
| Evaluation of Appearance Stability | 50° C. | | A | A | A | A | A |
| | 30° C. | | B | B | B | A | B |
| Evaluation of Fluidity (Viscosity/Pa · s) | 50° C. | | B | A | A | A | A |
| | | | 5.4 | 0.75 | 0.85 | 3.6 | 0.080 |
| | 30° C. | | B | A | A | B | A |
| | | | 9.6 | 2.0 | 2.1 | 6.3 | 0.10 |
| Evaluation of Restoration from Solidification at Low Temperature (Viscosity/Pa · s) | | | B | A | A | B | A |
| | | | 9.7 | 3.9 | 4.5 | 7.8 | 1.3 |

TABLE 3

| | | | Examples | | | | |
|---|---|---|---|---|---|---|---|
| | | | 11 | 12 | 13 | 14 | 15 |
| Components (mass %) | Component (a) | α-SF-Na in α-SF-1 | | | | | |
| | | α-SF-Na in α-SF-2 | 38 | 38 | 38 | 38 | 38 |
| | Component (b) | MEA | 0.5 | 1 | 1 | 1 | 3 |
| | | TEA | | | | | |
| | Component (c): Aromatic Sulfonic Acid | m-Xylene Sulfonic Acid | 1.5 | 1.8 | 3 | 5 | 9 |
| | | Ethylbenzene Sulfonic Acid | | | | | |
| | | PTS-H | | | | | |
| | | LAS-H | | | | | |
| | Aliphatic Sulfonic Acid | Methane sulfonic Acid | | | | | |
| | Component (d) | Water | Balance | Balance | Balance | Balance | Balance |
| | Optional Component | Ethanol | | | | | |
| (b)/(a) (molar ratio) | | | 0.083 | 0.17 | 0.17 | 0.17 | 0.50 |
| (b)/(c) (molar ratio) | | | 1.0 | 1.7 | 1.0 | 0.61 | 1.0 |
| Evaluation of Appearance Stability | 50° C. | | A | A | A | A | A |
| | 30° C. | | B | B | A | A | A |
| Evaluation of Fluidity (Viscosity/Pa · s) | 50° C. | | B | A | A | A | A |
| | | | 5.0 | 3.5 | 0.77 | 0.70 | 0.10 |
| | 30° C. | | B | B | A | A | A |
| | | | 9.3 | 5.1 | 2.0 | 1.8 | 0.15 |
| Evaluation of Restoration from Solidification at Low Temperature (Viscosity/Pa · s) | | | B | B | A | A | A |
| | | | 9.5 | 5.3 | 3.5 | 4.8 | 0.80 |

TABLE 3-continued

| | | | Examples | | | | |
|---|---|---|---|---|---|---|---|
| | | | 16 | 17 | 18 | 19 | 20 |
| Components (mass %) | Component (a) | α-SF-Na in α-SF-1 | | | | | |
| | | α-SF-Na in α-SF-2 | 38 | 38 | 38 | 44 | 33 |
| | Component (b) | MEA | | 1 | 1 | 1 | 0.8 |
| | | TEA | 1 | | | | |
| | Component (c): Aromatic Sulfonic Acid | m-Xylene Sulfonic Acid | 1 | | | 3 | |
| | | Ethylbenzene Sulfonic Acid | | 3 | | | |
| | | PTS-H | | | 3 | | |
| | | LAS-H | | | | | 4.2 |
| | Aliphatic Sulfonic Acid | Methane sulfonic Acid | | | | | |
| | Component (d) | Water | Balance | Balance | Balance | Balance | Balance |
| | Optional Component | Ethanol | | | | | 10 |
| (b)/(a) (molar ratio) | | | 0.068 | 0.17 | 0.17 | 0.14 | 0.15 |
| (b)/(c) (molar ratio) | | | 1.2 | 1.0 | 0.94 | 1.0 | 1.0 |
| Evaluation of Appearance | | 50° C. | A | A | A | A | A |
| Stability | | 30° C. | B | B | B | A | B |
| Evaluation of Fluidity (Viscosity/Pa · s) | | 50° C. | B | A | A | B | A |
| | | | 5.7 | 0.70 | 0.80 | 4.4 | 0.060 |
| | | 30° C. | B | A | A | B | A |
| | | | 9.8 | 1.7 | 2.0 | 5.9 | 0.080 |
| Evaluation of Restoration from Solidification at Low Temperature (Viscosity/Pa · s) | | | B | A | A | B | A |
| | | | 9.9 | 4.5 | 4.0 | 7.2 | 1.1 |

TABLE 4

| | | | Comparative Examples | | | | | |
|---|---|---|---|---|---|---|---|---|
| | | | 1 | 2 | 3 | 4 | 5 | 6 |
| Components (mass %) | Component (a) | α-SF-Na in α-SF-1 | 38 | 38 | 38 | 38 | 38 | 38 |
| | | α-SF-Na in α-SF-2 | | | | | | |
| | Component (b) | MEA | 0.5 | | 0.1 | 1 | 1 | 1 |
| | | TEA | | | | | | |
| | Component (c): Aromatic Sulfonic Acid | m-Xylene Sulfonic Acid | | 1.5 | 0.3 | 0.3 | 10 | |
| | | Ethylbenzene Sulfonic Acid | | | | | | |
| | | PTS-H | | | | | | |
| | | LAS-H | | | | | | |
| | Aliphatic Sulfonic Acid | Methane sulfonic Acid | | | | | | 1.5 |
| | Component (d) | Water | Balance | Balance | Balance | Balance | Balance | Balance |
| | Optional Component | Ethanol | | | | | | |
| (b)/(a) (molar ratio) | | | 0.081 | 0 | 0.016 | 0.16 | 0.16 | 0.16 |
| (b)/(c) (molar ratio) | | | — | 0 | 10.0 | 10.0 | 0.30 | — |
| Evaluation of Appearance | | 50° C. | C | C | C | C | C | C |
| Stability | | 30° C. | C | C | C | C | C | C |
| Evaluation of Fluidity (Viscosity/Pa · s) | | 50° C. | C | C | C | C | C | C |
| | | | — | — | — | — | — | — |
| | | 30° C. | C | C | C | C | C | C |
| | | | — | — | — | — | — | — |
| Evaluation of Restoration from Solidification at Low Temperature (Viscosity/Pa · s) | | | C | C | C | C | C | C |
| | | | — | — | — | — | — | — |

| | | | Comparative Examples | | | | | |
|---|---|---|---|---|---|---|---|---|
| | | | 7 | 8 | 9 | 10 | 11 | 12 |
| Components (mass %) | Component (a) | α-SF-Na in α-SF-1 | 38 | 38 | 67 | | | |
| | | α-SF-Na in α-SF-2 | | | | 38 | 38 | 38 |
| | Component (b) | MEA | 5 | | 1 | 0.5 | | 0.1 |
| | | TEA | | | | | | |

TABLE 4-continued

| | | | | | | | |
|---|---|---|---|---|---|---|---|
| Component (c): Aromatic Sulfonic Acid | m-Xylene Sulfonic Acid | 15 | | 3 | | 1.5 | 0.3 |
| | Ethylbenzene Sulfonic Acid | | | | | | |
| | PTS-H | | | | | | |
| | LAS-H | | | | | | |
| Aliphatic Sulfonic Acid | Methane sulfonic Acid | | | | | | |
| Component (d) | Water | Balance | Balance | Balance | Balance | Balance | Balance |
| Optional Component | Ethanol | | 10 | | | | |
| (b)/(a) (molar ratio) | | 0.81 | 0 | 0.092 | 0.083 | 0 | 0.017 |
| (b)/(c) (molar ratio) | | 1.0 | 0 | 1.0 | — | 0 | 1.0 |
| Evaluation of Appearance | 50° C. | A | A | A | C | C | C |
| Stability | 30° C. | B | C | C | C | C | C |
| Evaluation of Fluidity | 50° C. | A | A | C | C | C | C |
| (Viscosity/Pa · s) | | 0.10 | 0.10 | — | — | — | — |
| | 30° C. | C | A | C | C | C | C |
| | | — | 0.16 | — | — | — | — |
| Evaluation of Restoration from Solidification at | | C | C | C | C | C | C |
| Low Temperature (Viscosity/Pa · s) | | — | — | — | — | — | — |

TABLE 5

| | | | Comparative Examples | | | | | |
|---|---|---|---|---|---|---|---|---|
| | | | 13 | 14 | 15 | 16 | 16 | 18 |
| Components (mass %) | Component (a) | α-SF-Na in α-SF-1 | | | | | | |
| | | α-SF-Na in α-SF-2 | 38 | 38 | 38 | 38 | 38 | 67 |
| | Component (b) | MEA | 1 | 1 | 1 | 5 | | 1 |
| | | TEA | | | | | | |
| | Component (c): Aromatic Sulfonic Acid | m-Xylene Sulfonic Acid | 0.3 | 10 | | 15 | | 3 |
| | | Ethylbenzene Sulfonic Acid | | | | | | |
| | | PTS-H | | | | | | |
| | | LAS-H | | | | | | |
| | Aliphatic Sulfonic Acid | Methane sulfonic Acid | | | 1.5 | | | |
| | Component (d) | Water | Balance | Balance | Balance | Balance | Balance | Balance |
| | Optional Component | Ethanol | | | | | 10 | |
| | (b)/(a) (molar ratio) | | 0.17 | 0.17 | 0.17 | 0.83 | 0 | 0.094 |
| | (b)/(c) (molar ratio) | | 10.0 | 0.30 | — | 10.0 | 0 | 10.0 |
| | Evaluation of Appearance | 50° C. | C | C | C | A | A | A |
| | Stability | 30° C. | C | C | C | B | A | C |
| | Evaluation of Fluidity | 50° C. | C | C | C | A | A | C |
| | (Viscosity/Pa · s) | | — | — | — | 0.10 | 0.080 | — |
| | | 30° C. | C | C | C | C | A | C |
| | | | — | — | — | — | 0.14 | — |
| | Evaluation of Restoration from Solidification at | | C | C | C | C | C | C |
| | Low Temperature (Viscosity/Pa · s) | | — | — | — | — | — | — |

From the results shown in Tables 2-5, it was confirmed that the surfactant solutions of Examples 1-20, which were obtained by using the present invention, contained the α-SF salt at a high concentration and had the fluidity at room temperature and the restoration from solidification at low temperature.

In addition, it was confirmed that the surfactant solutions of Examples 1-20 had good appearance stability.

What is claimed:

1. A surfactant solution comprising:

a component (a): an α-sulfonated fatty acid ester salt;

a component (b): at least one alkanolamine selected from the group consisting of monoethanolamine and triethanolamine;

a component (c): at least one aromatic sulfonic acid selected from the group consisting of a xylene sulfonic acid, an ethylbenzene sulfonic acid, a toluene sulfonic acid, and a linear alkylbenzene sulfonic acid; and a component (d): water, wherein the content of the component (a) is within a range from 30 to 45 mass %, the molar ratio represented by (b)/(a) is within a range from 0.05 to 0.5, the molar ratio represented by (b)/(c) is within a range from 0.5 to 2, wherein the component (a) includes a plurality of compounds independently having the formula (a1):

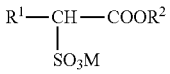

(a1)

wherein $R^1$ represents a hydrocarbon group having 10 to 18 carbon atoms, $R^2$ represents a hydrocarbon group having 1 to 6 carbon atoms, and M represents a counter ion, such that component (a) includes:

a compound (C16) having the formula (a1) in which $R^1$ represents a hydrocarbon group having 14 carbon atoms, and a compound (C18) having the formula (a1) in which $R^1$ represents a hydrocarbon group having 16 carbon atoms, provided that the mass ratio represented by compound (C16):compound (C18) is 45:55 to 95:5, and provided that the total content of compound (C16) and (C18) is at least 95 mass % of the total mass of the component (a).

2. The surfactant solution according to claim 1, wherein the total content of the component (a), the component (b), the component (c) and the component (d) is 90 mass % or more.

3. The surfactant solution according to claim 2, wherein the total content of the component (a), the component (b), the component (c) and the component (d) is 99 mass % or more.

4. The surfactant solution according to claim 1, further comprising: ethanol at 5 to 15 mass %, wherein the total content of the component (a), the component (b), the component (c), the component (d) and ethanol is 99 mass % or more.

* * * * *